US005683295A

United States Patent [19]

Frain

[11] Patent Number: 5,683,295

[45] Date of Patent: Nov. 4, 1997

[54] ELECTRONIC BINGO GAME SYSTEM WITH AUTOMATIC SCORING

[76] Inventor: John J. Frain, 40 Kildare Walk, Breezy Point, N.Y. 11697

[21] Appl. No.: 662,636

[22] Filed: Jun. 13, 1996

[51] Int. Cl.[6] ..... A63F 3/06

[52] U.S. Cl. ..... 463/19

[58] Field of Search ..... 463/16, 17, 18, 463/19, 20, 21, 22, 30; 273/236, 237, 269

[56] References Cited

U.S. PATENT DOCUMENTS

| | | | |
|---|---|---|---|
| 2,760,619 | 8/1956 | Peak . | |
| 3,671,041 | 6/1972 | Taylor et al. . | |
| 4,218,063 | 8/1980 | Cooper et al. . | |
| 4,455,025 | 6/1984 | Itkis . | |
| 4,475,157 | 10/1984 | Bolan . | |
| 4,624,462 | 11/1986 | Itkis . | |
| 4,661,906 | 4/1987 | DiFrancesco et al. . | |
| 4,768,151 | 8/1988 | Birenbaum et al. . | |
| 4,798,387 | 1/1989 | Richardson . | |
| 4,875,686 | 10/1989 | Timms | 273/237 |
| 5,230,514 | 7/1993 | Frain . | |
| 5,338,042 | 8/1994 | Greer | 273/269 |

*Primary Examiner*—George Manuel

*Attorney, Agent, or Firm*—Watson Cole Stevens Davis, P.L.L.C.

[57] ABSTRACT

The present invention is directed to an electric bingo game card which includes a first group of selectors, each selector arranged in a particular location on the card in an ordered matrix representing numbers of a bingo card face in a mark every time configuration. Each selector is manually selectable for producing, when actuated, an output corresponding to the location in the matrix of the selected one of the numbers. A plurality of matrices of game cards are provided which are in electrical communication with the control faces so that each time a number on a control face is actuated, a corresponding number on one of the controlled or play faces is actuated. Logic means is responsive to the first group of actuators on the control faces for providing an output when a win is detected and a display provides a visual indication on the game playing device upon such occurrence. Automated central control and checking are provided.

23 Claims, 3 Drawing Sheets

CENTRAL CONTROL
Ex 14
CHECK
ROM
LOGIC
MEM
BINGO
R
34
15
15'
40
47'
64
56
58
63
54
52
52
60
46'
23
44
12
28a
42
10'
61
46
47
5

Fig. 1a.
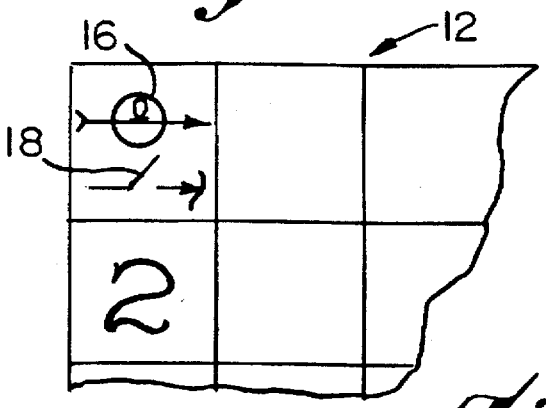
Fig. 1b.
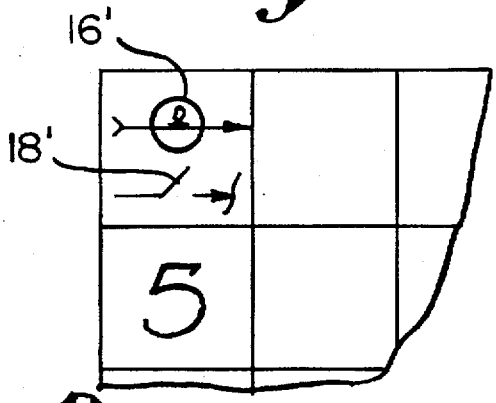
Fig. 2.
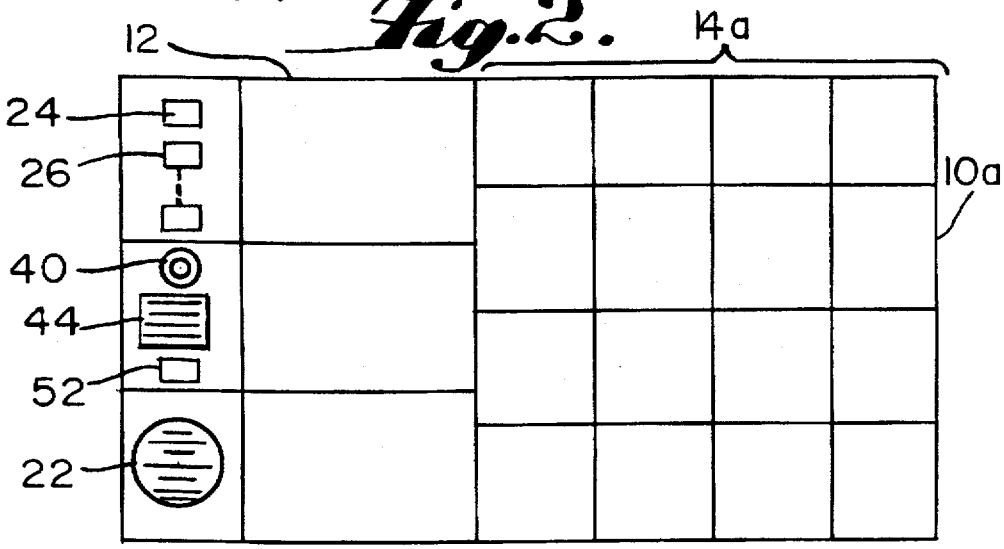
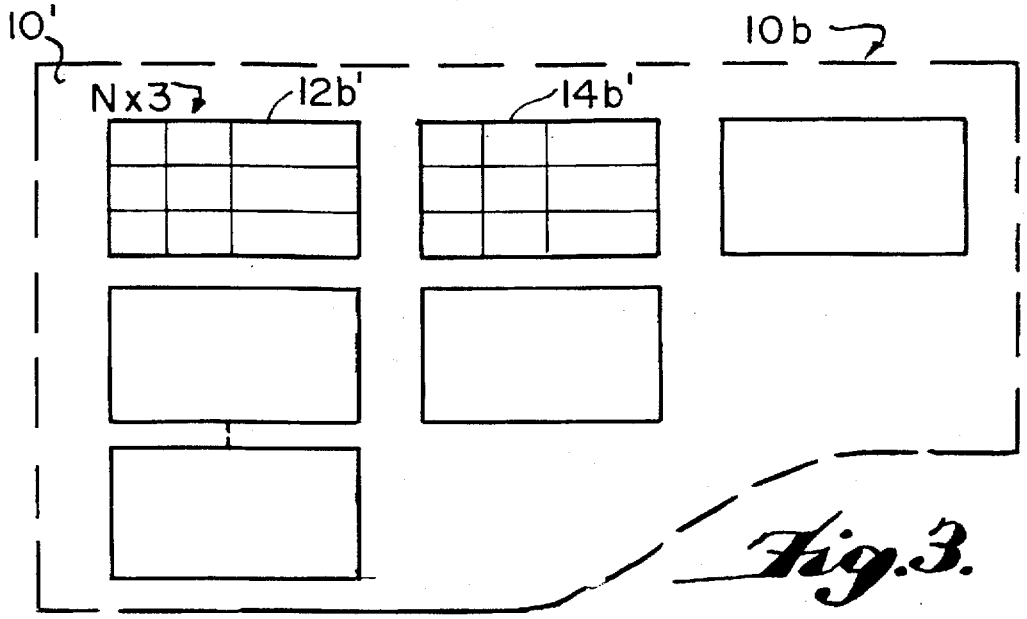
Fig. 3.

ELECTRONIC BINGO GAME SYSTEM WITH AUTOMATIC SCORING

BACKGROUND OF THE INVENTION

The invention generally relates to a bingo game card, and in particular, the invention relates to an electric bingo game card which is adapted for tracking play on a plurality of game faces controlled generally by a lesser number of game faces arranged in a mark every time configuration.

Bingo is a popular game which is played extensively throughout the United States and other countries. The game is played utilizing a game card having an ordered set or matrix of numbered squares in the familiar 5×5 array. Typically, the numbers 1–75 are divided into five sets of fifteen numbers, each set being associated with each vertical column in the matrix. The arrangement of numbers within each of the five groups is random and contains many thousands of different combinations or faces of bingo cards. During the game, numbers are called, and the player marks or covers the squares with chips or some marking device.

The typical player purchases a plurality of faces which are arranged a 3×N matrix of faces on a sheet. As a practical matter, there are only so many faces that a player can keep track of while playing the game manually. This limit is a function of the space available to the player, but more importantly, there is only a certain amount of time available between each called number for the player to mark the corresponding boxes on the faces that he or she is playing. Thus, it would be desirable to enable the players to mark more faces thereby generating greater excitement for the player and greater revenue for the game operator.

There are a number of automated bingo game playing devices which are capable of storing each face being played by the player. All the player need do is enter the called number and the device will electronically mark in memory all of the faces the player has corresponding to the called number. When a winning combination is detected, the device provides a signal and displays the winning face. Such a device allows the user to play many more faces than is possible with manual marking. However, there are a number of disadvantages.

First, the player merely enters each called number in a key pad on the device. The player must then wait until the next number is called before performing any further activity associated with the game. Typically, the called time between numbers is about 15 seconds and this type of game is both uninteresting and time consuming from the player's point of view. The only real advantage is that the player can multiply his chances of winning by playing many more faces than is otherwise possible with a manual marking system.

A second disadvantage really relates to the other players who usually do not like competing against a machine. Players using manual marking methods feel, and rightly so, that there chances of winning are reduced because one or more players may have automated means for marking and scoring many more cards or faces than is possible for the manual player to handle. Thus, is there is some resentment and, in fact, some operators do not permit automated play, even though selected players do indeed purchase more faces than the average player. From the operator's point of view it would be just as profitable to enable all players to purchase a few extra faces than to have a few players with many faces.

Automated devices have another disadvantage, namely that the game quality is diminished for the player who uses an automated game playing device. As noted above, the player is simply relegated to a data entry function. There is no excitement associated with entering numbers because the player cannot observe any meaningful way what status of the various faces is that he or she is playing. The player simply waits for a winning indication after entry of data. The manual players on the other hand at least have the thrill and fun of watching the game board fill up and anticipating a winning call.

The foregoing notwithstanding, it is not out of the question that operators would not encourage the use of automated devices if it could be made practical. For example, automated game playing has the advantage that it can eliminate some or if not all of the waste paper associated with the game play. Literally, hundreds of thousands of tons of newsprint are consumed each year throughout the United States by bingo game operators. The various faces are printed on this inexpensive disposable paper. Typically, the operator buys packages of faces which are supplied by game distributors in groups of 25, 50 or 100, etc. These packages include not only a series of straight bingo games, but also include so-called specials, which are variations of the game that add excitement and variety to the game play at various halls throughout the United States. The packages are oftentimes bundled in anticipation of a house which contains a certain number of patrons. Thus, if the house has 215 players, a package of 225 or 250 may be thus unbundled and once so unbundled, the extras, unless used, must be discarded. Discarded faces thus cost the operator profits and adds to the waste paper burden associated with these games. It would thus be desirable to provide an automated game playing system in which for each called number the player has an opportunity to enter the data in a way which enhances game play and also allows the player to keep track of multiple faces at the same time.

It is also desirable to increase the number of faces that a player may practically keep track of during an evening of play without losing the sense of the game.

It is also desirable to allow such additional play to increase the profitably of the game for the operators.

It is additionally desirable to provide an automated bingo game playing device which allows the operator to put in play only that number of devices which correspond to the number of players in the house on a particular day without the waste associated with packages which must be opened in increments.

It is also desirable to speed up the game by allowing players to manually enter data with a sense of play, which entered data is displayed on all of a plurality of available faces for that particular player and yet at the same time, reduce the amount of time between calls which would otherwise be increased as the average number of faces per player increases.

In this connection, it should be understood that the time between the calls must be limited to reduce boredom, and yet must be sufficient so that the players can mark all of the faces in front of them. Thus, it is desirable to increase the number of faces available, yet at the same time, decrease the amount of time between calls thereby heightening the excitement of the game and the quality of play.

It is also desirable to reduce the possibility of fraud or cheating. As is well known in the bingo game business, a certain practical number of the available faces for the game have been systematically recorded so that each game face has associated therewith a code which identifies the face by its configuration. Typically, the code is listed in a free space in the center of each face. In addition, distributors of the bingo paraphernalia usually serialize and color code the faces so that the operator can keep track of valid faces which have been sold for the particular evening's play. In this way, players who do not wish to purchase sheets from the operator are prevented from bringing in unpurchased sheets so that they can play without charge. However, during play, when a player calls out "Bingo" indicating a possible win, not only must the numbers be checked but also the serial number of the face must be called out so that it can be checked to see if it is a valid face for that evening's play. All of this is time consuming and is especially an annoyance to the vast majority of the players who have not won and are simply waiting for the next game to begin.

Thus, it would be desirable to arrange an automated game playing device which has encoded thereon information sufficient to allow the operator or his employees to quickly check the validity of the device in play.

SUMMARY OF THE INVENTION

The present invention is directed to an electric bingo game card which includes a first group of selectors, each selector arranged in a particular location on the card in an ordered matrix representing numbers of a bingo card face in a mark every time configuration. Each selector is manually selectable for producing, when actuated, an output corresponding to the location in the matrix of the selected one of the numbers. A plurality of matrices of game cards are provided which are in electrical communication with the control faces so that each time a number on a control face is actuated, a corresponding number on one of the controlled or play faces is actuated. Logic means is responsive to the first group of actuators on the control faces for providing an output when a win is detected, and a display provides a visual indication on the game playing device upon such occurrence.

In accordance with the variation, a second group of selectors representing game variations is selected for providing a logical output.

BRIEF DESCRIPTION OF THE DRAWINGS

FIGS. 1A and 1B show fragmentary portions of the card of FIG. 1;

FIG. 2 illustrates a variation with control faces sized for manual play and a larger number of smaller play faces;

FIG. 3 shows a variation of the game for a ninety number N×3 face; AND

DESCRIPTION OF THE INVENTION

Figure 1:
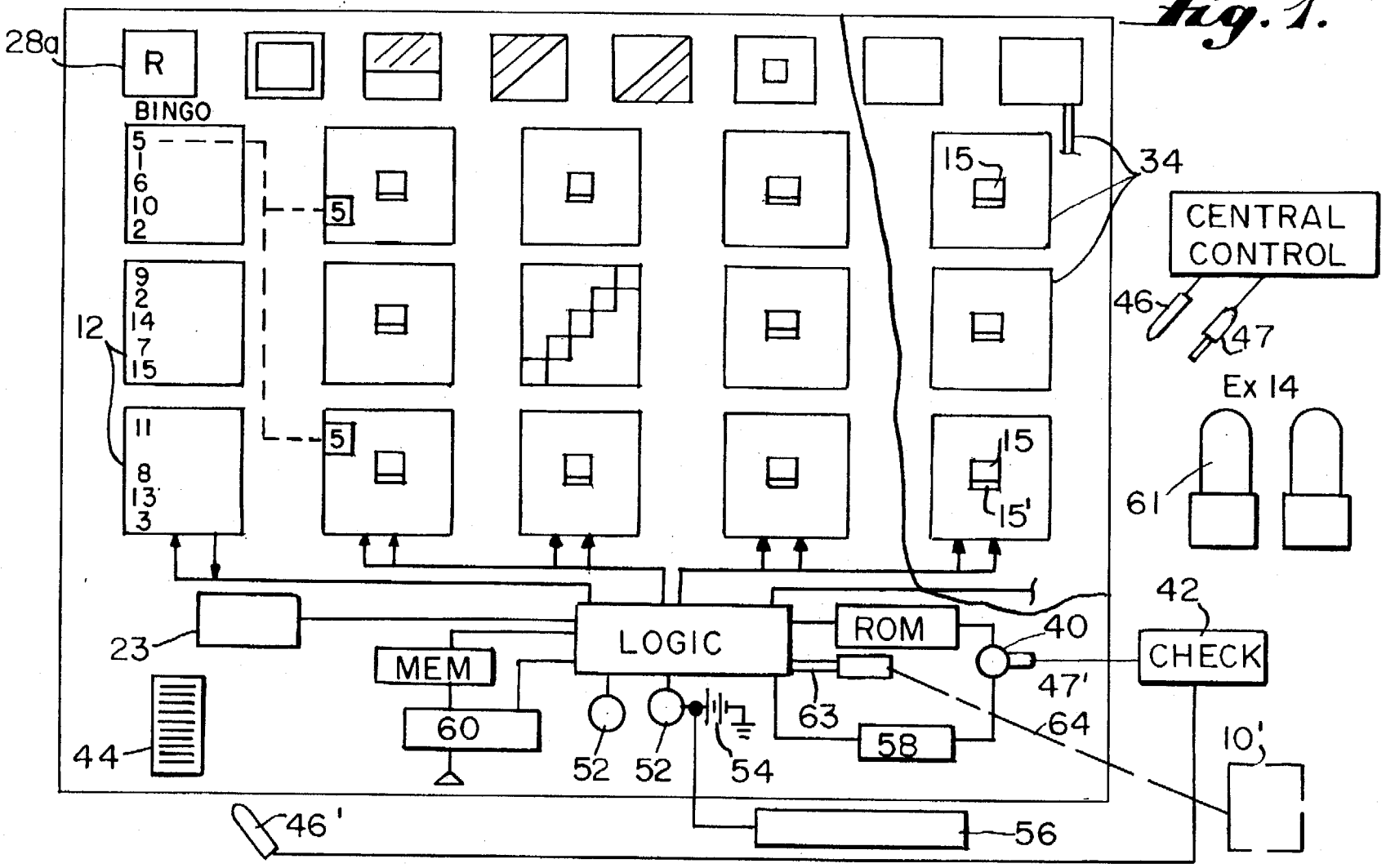
FIG. 1 is a plan view of an electric bingo game card in accordance with one embodiment of the present invention.

FIG. 1 illustrates an exemplary embodiment of the present invention. The invention comprises a game board 10 configured in a 1×3 array of control faces 12 and an N×3 array of play faces 14. The control faces 12 and the play faces 14 may be identified respectively by location on the board, e.g., 12-1 . . . 12-n and 14-1 . . . 14-n. In order to make the game interesting for a player, the control faces 12 are arranged in a so-called mark every time configuration in which every number from 1–75 is located somewhere in the 1×3 array of control faces 12. Thus, every time a number is called by the operator, the player will mark one of the three control faces 12.

The play faces 14 may contain a less restricted array of faces, that is, one or more of the play faces may have a number matching the called number or not depending upon the numerical arrangement. The center box 15 of each play face, marked with an "X", is the typical free space in bingo. Each free space 15 has a numerical code 15' uniquely identifying the play face. In the exemplary embodiment illustrated, the numerical codes may be used for verification and record keeping as hereinafter described.

In accordance with the invention, each number on the control face 12 has associated therewith a light 16 and a switch 18 shown in the fragmentary view of FIG. 1A. Each of the play faces 14 may have associated therewith a light 16' and an optional switch 18', likewise shown in the fragmentary view of FIG. 1B. Thus, each time a number on one of the control faces 12 is actuated the number is illuminated thereon, as well as any matching corresponding number on the play faces 14. For example, when the number "B5" is called, the player may activate the corresponding switch on the number "B5" box in the control face, as shown in FIG. 1. As a result, any and all number "B5" boxes 10 in the play faces, responsive to the switch 18 is thereby illuminated. The switches 18 on the control face 12 are effective to cause the lights 16 on the control faces 14 to become illuminated. Likewise, the switches 18 may be electronically coupled to the lights 16' corresponding to the same number on the control faces 14 as well. Thus, when a switch 18 on the control face 12 is actuated, the corresponding number appearing on any of the play faces is likewise actuated.

A logic circuit 20 which may be in the form of a microprocessor. A memory 21 may be provided which stores all the faces 12 and 14 on the card 10, and is responsive to the switches 18 (or 18') to sense the various possible winning combinations. If, for example, a diagonal line 22 is achieved, the logic circuit 20 produces a signal so that the line or winning combination provides a visual indication of a winning game, and the lights 16' in each box of the diagonal 22 flash. In addition, an audible alarm 23 may be provided in the card 10 to produce an audible indication as well. The memory 21 may be in the form of a read only memory (ROM).

The card 10 may further include a series of switches 24A–N in a variation selection 26 which may be used to select the variation of the game being played. For example, switch 24A may be for straight or regular bingo, whereas switch 24C may be for a full card. Written or symbolic indicia 28A–N on or adjacent to the respective switches 24A–N may be provided to allow a player to select the particular variation of the game in accordance with the instructions by the operator.

In accordance with the invention, logic circuit 20 may be buried or formed within the card 10 and may be responsively coupled to the switches 18 on the control faces and the switches 24A–N in the variation selector 26. The control faces 12 may be coupled to the logic circuit 20 by a control bus 32. Likewise, the variation selector 26 may be coupled to the logic circuit 20 by a corresponding bus 34. The logic circuit 20 provides bus 36 coupled to the lights 16 on the control faces 12 and the lights 16' and optional switch 18' on play faces 14. Likewise, an audio output 38 may be coupled to the audible alarm 23. When a winning combination is sensed, the logic circuit 20 provides an output on the output bus 36 to selectively illuminate the winning combination and to dim or blank out non-winning combinations. At the same time, the light 16 on the control faces 12 may remain illuminated for purposes of visual checking of the winning combination.

In accordance with another aspect of the invention, the logic circuit 20 may include a check input/output 40 and a check memory 41 for storing played numbers which may be coupled to an electronic checking device 42. The device may be either centrally located or hand-carried by employees of the operator. When a player claims a win, the checker may couple the electronic checking device 42 to check memory 41 via the checking input/output (I/O) 40 of the card 10 to verify that the winning combination is valid. The electronic checking device 42 may also perform other checking functions as hereinafter described.

A code strip 44 may be provided on the card to serve a number of functions. The code strip 44 may be a bar code, a magnetic code or some optical code, as desired. When the card 10 is supplied by the operator for the evening's play, the transaction may be recorded by the operator at a central control location 45 by means of a scanner 46 coupled thereto. The checker 42 may also be supplied with a scanner 46' so that, in addition to checking the winning combination, the checker may scan the card 10. The central location 45 may be equipped with a connector 47, so that checking may also be accomplished via I/O 40. Thus, in order to be awarded a prize, the player not only must have a winning combination, but must also have a card which is recognizable and has been properly recorded as valid for the evening's play. The card 10 may be checked and verified at the central control via checking I/O 40 as described hereinafter.

As illustrated in the drawing, when the caller announces called numbers, the player actuates the switches 18 on the control faces 12. When the winning combination occurs, the lights 16 are illuminated on the winning face. In the example illustrated, the winning play face shown in the second row and second column, has the diagonal 22 illuminated, indicating a winner. The corresponding numbers on the control faces 12 are illuminated in order to allow for checking. It should be understood, however, that it is possible to have a winning combination on the control faces as well. It does not matter where the win occurs, although the prize may vary depending upon the degree of difficulty involved. For example, a mark every time arrangement on the control faces 12 may present a less challenging win probability than on the less restricted play face 14.

The logic means 20 has a reset 50 to restart the game. A power switch 52 from a power source 54 provides power for the game. The power source 54 may be a rechargeable battery. Alternatively, or in addition, a photovoltaic device 56 may be provided to supply power or to supplement or recharge the battery 54.

In addition to the foregoing, an enable input may be provided to the logic circuit 20 via enable circuit 58 which, in turn, may be activated only by the operator by means of the checking input/output 40. The enable signal may be supplied by the central control 45 or by the electronic checking device 42. Thus, when the game card 10 is supplied for the evening, in addition to reading the code strip 44, a signal may be provided to the logic circuit 20 enabling the game to operate. The enabling device 58 may be a timer or counter for allowing play for a limited period, e.g., for the day, or for a selected number of games or both.

The arrangement of the invention provides a number of advantages. One advantage, in terms of enjoyment, is that the player gets to enter data each time a number is called and entry of that data adds excitement to the game because it conforms with an actual bingo play. It is not simply the entry of data into a key pad. If the player does not properly mark a called number, as in any bingo game, he or she will not win. Thus, the player must pay attention and participate in the game. At the same time, rapid scoring is facilitated by means of a readily checkable system. An advantage to the player is that he or she may purchase many more faces than could be conveniently or comfortably tracked manually. At the same time, the element of game play remains because the player must do something in order to participate. The time between calls may be significantly reduced because time does not have to be allotted for players to mark all of the called numbers.

In a variation of the game, the switches 18 on the control face 12 may be actuated manually by the player and the logic circuit 20 may allow the corresponding numbers on the play faces 14 to be illuminated either for a set period of time, e.g., 10 seconds or until the next switch 18 on the play face 12 is actuated. In the meantime, the player may be required to actuate each of the illuminated numbers on the play face as well by manually pressing the number and activating a play face switch 18', as illustrated. Thus, an additional challenge is presented to the player, providing greater incentive to play and pay attention, thereby adding excitement. Such an arrangement could be a variation on the game provided by variation section 26, that is, some games may be passive whereby actuation of the control face illuminates all of the corresponding play face numbers. Alternatively, some variations of the game may require actuation of the control face switches 18 but also the play face switches 18'.

In yet another embodiment of the invention, the card 10 may be equipped with either a passive or active theft deterrent device 60, e.g., imbedded inductive loop or an active microchip formed within the body of the card. Such a device may be used to prevent theft of the card in the event that the player leaves the hall or play site without returning the card. Such a device may provide communication with an exit detector 61 by means of antenna 62 so as to cause the card to be destroyed or disabled if the player attempts to exit the hall so that it may not be used again, or both, thereby discouraging theft. The theft deterrent device 60 may also, if desired, be coupled to the audible alarm 23. It may likewise be coupled to check input/output 40 for verification. The logic circuit 20 may also contain a code stored in a ROM 62 which will likewise be useful to validate the card via checking input/output 40. The ROM 62 may fuse if the card is stolen, thereby acting as an additional or alternative theft deterrent.

In accordance with another aspect of the invention, inasmuch as rapid game play is facilitated, a player may buy or rent more than one multiple face card for the evening and have sufficient time to actuate a called number on each of a plurality of cards thereby multiplying the variety and excitement of the game. Alternatively, the multiple cards 10' may be liked by a linking box 63 and cable 64 supplied with a suitable cable connection (e.g., an RS232). One set of control faces may operate all the linked cards, 10, 10', etc.

In yet another embodiment shown in FIG. 2, it may be desirable to have a set of three control faces 12 on card 10A of a size and shape adapted for manual actuation of the switches 18 and a large plurality of play faces 14A of a smaller size adapted for visualization of winning combinations. Thus, more play faces may be located on the card while at the same time providing a manually actuable set of control faces in a size which is convenient for use by a wide variety of players.

Other known games of the bingo type may be played. For example, the game board 10B shown in FIG. 3 is a 3×N matrix for playing ninety numbers. This variation includes control faces 12B and play faces 14B.

Figure 4:
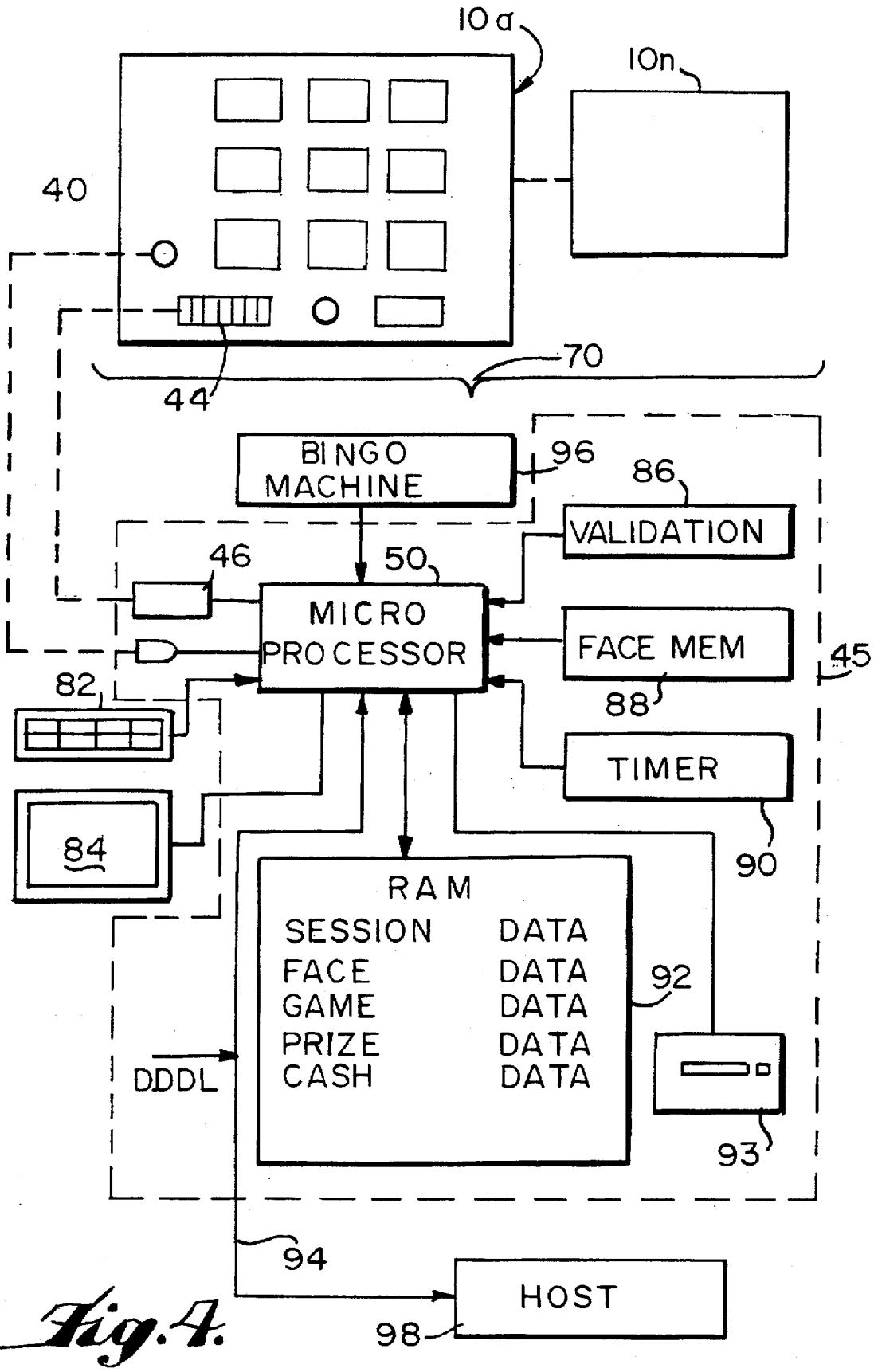
FIG. 4 illustrates a generalized system block diagram.

FIG. 4 illustrates a generalized system arrangement of the invention including a number of cards 10A–10N representing a multiple player session 70, the central control 45 and a host computer 72. In the embodiment illustrated, the central control 45 included may be configured as a microprocessor 80 having a keyboard 82 input; a display 84 for monitoring operations; a validation memory 86 for storing card validation information; a face memory 88 for storing identification codes 15'; a timer/counter 90 for establishing an operation interval for each play session; a random access memory (RAM) 92 for storing session data such as the face data, cash transactions, game data, prize data, etc.; and a direct distance dial line 94 for remote communication. The central location may also include a bingo machine 96 for displaying called bingo numbers. The direct dial distance line 94 may be coupled to a host computer 98. The host computer may belong to a franchisor or a game proprietor for monitoring various session locations.

In the embodiment illustrated, the play face code 15' may be sequential so that the data on the first face 14-1 represents all the faces 14 on the board. Encoded data 15' representing the plurality of card faces 14 appearing on the board 10 may be downloaded to the central location 45. This download may be achieved at the time that the board 10 is rented for a session. The user takes the board 10 to the central control 45 which may be a specialized point of purchase terminal whereby a connection is made to the board 10. The connection may be by a variety of appropriate means including the scanner 46, the connector 41 or the chip 60. Checking may also be achieved by manually entering the data into the microprocessor via the keyboard 76. For example, the operator may sweep the light wand or scanner 46 over the bar coded area 44 on the board which thereby enters the board data into the microprocessor which may call up the validation data 86 and face memory data 88 from the corresponding memories for storage in the random access memory. The timer/counter 90 may also be activated to record the session. It should be understood that the timer/counter 90 may also provide a communications link to the board 10 enabling it only for a selected interval of time, or number of plays, or both. Such an arrangement is a theft deterrent as well as a security for the operator so the card may not be used at a future time without appropriate payments.

The central control 45 keeps track of all the boards that are in play and also may function as a register for cash and credit transactions during each session.

The central control 45 may be coupled to the bingo machine 96 that is used to call numbers during the session. The called numbers may be stored in he random access memory 92. In this way, verification of a win may be determined and recorded so that accurate accounting of prize money and winners may be maintained.

At some time after the session is concluded, the host computer 98 may receive dial up information from the central control 45 via the direct distance dial line 94 or other appropriate communications channel. Backup data may be provided by means of a disc drive 93.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed:

1. An electric bingo game card comprising:

a first set of selectors, each selector arranged in a particular location on the card in an ordered matrix of control faces representing numbers of a bingo card face, each selector being manually selectable for producing, when actuated, an output corresponding to the location in the matrix of the selected one of the numbers;

a plurality of matrices of play faces in electrical communication with the control faces so that each time a number on a control face is actuated, a corresponding number on the play faces is actuated;

logic means responsive to the first set of selectors for providing an output when a winning combination is detected on any one of the control faces and play faces; and means responsive to the logic means for providing a visual indication of a winning combination on the bingo game card upon such occurrence.

2. The electric bingo game card of claim 1 further comprising:

a second group of selectors representing game variations for providing a logical output; and said logic means responsive to the second group of selectors for providing a winning indication for a selected variation.

3. The electric bingo game card of claim 1 wherein the control faces are arranged in a mark every time configuration.

4. The electric bingo game card of claim 1 further including coded means for identifying the card as a valid card.

5. The electric bingo game card of claim 4 wherein the coded means comprises at least one of a bar code, optical code, magnetic code and a read only memory.

6. The electric bingo game card of claim 1 further including theft deterrent means for detecting removal of the card from a selected area.

7. The electric bingo game card of claim 6 wherein the theft deterrent means comprises a fusable circuit for disabling the card.

8. The electric bingo game card of claim 6 wherein the theft deterrent comprises means for providing an audible alarm.

9. The electric bingo game card of claim 6 wherein the theft deterrent means includes means for providing a signal in response to the proximity of the card to a restricted area.

10. The electric bingo game card of claim 9 wherein the means for producing the signal comprises a proximity sensor.

11. The electric bingo game card of claim 1 wherein the control faces are sized for manual actuation.

12. The electric bingo game card of claim 1 wherein the play faces are sized to a visual observation.

13. The electric bingo game card of claim 1 further including a timer for enabling the card for a selected period of play.

14. The electric bingo game card of claim 1 further including a counter for enabling the card for a selected number of plays.

15. An operator controlled bingo card system comprising:

a player controlled electric game card including:

a first set of selectors, each selector arranged in a particular location on the card in an ordered matrix of control faces representing numbers of a bingo card face, each selector being manually selectable for producing, when actuated, an output corresponding to the location in the matrix of the selected one of the numbers;

a plurality of matrices of play faces in electrical communication with the control faces so that each time a number on a control face is actuated, a corresponding number on the play faces is actuated;

logic means responsive to the first set of selectors for providing an output when a winning combination is detected on any one of the control faces and play faces;

means responsive to the logic means for providing a visual indication of a winning combination on the bingo game card upon such occurrence; and operator control means for verifying the winning combination.

16. The bingo game card system of claim 15 wherein the logic means includes means for storing information including the configuration of each face and the status of activated selectors.

17. The bingo card system of claim 16 wherein the means for verifying the winning combination includes logic checking means for engaging the logic means to the read stored information therein.

18. The bingo card system of claim 15 wherein the checking means is responsive to called numbers for comparison for the activated selectors corresponding to played numbers stored in the logic means.

19. The bingo card system of claim 15 further including operator controlled means for enabling the card.

20. The bingo card system of claim 15 further including a timer for enabling the card for a selected period of play.

21. The bingo card system of claim 15 further including a counter for enabling the card for a selected number of plays.

22. The bingo game card system of claim 15 including means for storing face data for each card.

23. The bingo game card system of claim 15 further including a bingo machine operable for calling numbers and coupled to the central control for receiving the called numbers.

* * * * *